US010721969B2

(12) United States Patent
Capuano et al.

(10) Patent No.: US 10,721,969 B2
(45) Date of Patent: Jul. 28, 2020

(54) ELECTRONIC VAPING DEVICE

(71) Applicant: Nu Mark Innovations Ltd., Beit Shemesh (IL)

(72) Inventors: Sammy Capuano, Ramat Bet Shemesh (IL); Zvika Feldman, Tzoran (IL)

(73) Assignee: Altria Client Services LLC, Richmond, VA (US)

( * ) Notice: Subject to any disclaimer, the term of this patent is extended or adjusted under 35 U.S.C. 154(b) by 7 days.

(21) Appl. No.: 16/222,186

(22) Filed: Dec. 17, 2018

(65) Prior Publication Data

US 2019/0110522 A1 Apr. 18, 2019

Related U.S. Application Data

(63) Continuation of application No. 14/086,004, filed on Nov. 21, 2013, now Pat. No. 10,154,691.

(60) Provisional application No. 61/729,647, filed on Nov. 26, 2012.

(51) Int. Cl.
*A24F 47/00* (2020.01)

(52) U.S. Cl.
CPC ..... *A24F 47/008* (2013.01)

(58) Field of Classification Search
None
See application file for complete search history.

(56) References Cited

U.S. PATENT DOCUMENTS 3,721,240 A 3/1973 Tamburri
4,446,332 A 5/1984 Dauser, Jr.
2009/0095312 A1* 4/2009 Herbrich ..... H05B 3/42 131/273
2011/0277761 A1 11/2011 Terry et al.
2011/0303231 A1 12/2011 Li et al.
2011/0304282 A1 12/2011 Li et al.
2012/0199146 A1 8/2012 Marangos
2013/0192617 A1* 8/2013 Thompson ..... A24F 47/008 131/329
2013/0263869 A1 10/2013 Zhu
2014/0007891 A1 1/2014 Liu

FOREIGN PATENT DOCUMENTS

CN 201830900 U 5/2011
CN 102106611 A 6/2011
CN 202077578 U 12/2011
(Continued)

OTHER PUBLICATIONS

Office Action from the India Patent Office for Indian Appl. No. 2984/CHEN/2015 dated Feb. 7, 2019.
(Continued)

*Primary Examiner* — Michael J Felton
*Assistant Examiner* — Katherine A Will
(74) *Attorney, Agent, or Firm* — Harness, Dickey & Pierce, P.L.C.

(57) ABSTRACT

An electronic cigarette ("e-Cig") may include an adapter component for connecting a battery portion of the e-Cig with the cartridge. The adapter may be configured to utilize a bonding device, such as a ring, cylinder, or sleeve component, for connecting wires without requiring soldering. The bonding device may press a wire at a contact point against a conductive material for transmission of electrical power.

24 Claims, 10 Drawing Sheets

(56) References Cited

FOREIGN PATENT DOCUMENTS

| | | | |
|---|---|---|---|
| CN | 202456410 | U | 10/2012 |
| EP | 0430566 | A2 | 6/1991 |
| TW | 201143825 | A | 12/2011 |
| WO | WO-2011/146365 | A2 | 11/2011 |
| WO | WO-2014008623 | A1 | 1/2014 |

OTHER PUBLICATIONS

Examination Report for EP Application No. 13 814 232.8 dated Mar. 6, 2019.
International Search Report and Written Opinion dated May 13, 2014 for PCT/IL2013/050972.
Office Action for corresponding Russian Application No. 2015125243 dated Oct. 27, 2016 and English translation thereof.
Office Action for corresponding Chinese patent application 201380061694.3, dated Nov. 30, 2016.
Office Action for corresponding Chinese application 201380061694.3 dated Jun. 20, 2017 and English Translation thereof.
Office Action for corresponding European Patent Application 13814232.8, dated Jul. 26, 2017.
European Patent Office Communication dated May 3, 2018 for EP Application No. 13814232.8.
European Office Action dated Oct. 2, 2018 in related European Application No. 13 814 232.8.

* cited by examiner

ELECTRONIC VAPING DEVICE

CROSS-REFERENCE TO RELATED APPLICATIONS

This is a continuation of, and claims priority under 35 U.S.C. § 120 to, U.S. application Ser. No. 14/086,004, filed Nov. 21, 2013, which claims priority under 35 U.S.C. § 120 to U.S. Application No. 61/729,647, filed Nov. 26, 2012.

TECHNICAL FIELD

This disclosure generally relates to an electronic cigarette ("e-cigarette," "e-Cig," or "eCig"). More particularly, this disclosure relates to internal connection of wires to metal components within an e-Cig cartridge.

BACKGROUND

An electronic cigarette ("e-cigarette," "e-Cig," or "eCig") is a device that emulates tobacco cigarette smoking, by producing smoke replacement that may be similar in its physical sensation, general appearance, and sometimes flavor (i.e., with tobacco fragrance, menthol taste, added nicotine etc.). A battery portion of the e-Cig includes a controller and battery for powering the device (e.g. providing electrical power) and a cartomizer portion generates an aerosol mist (i.e. e-smoke or vapor) that is a replacement for cigarette smoke. In particular, the cartomizer may use heat, ultrasonic energy, or other means to atomize/vaporize a liquid solution (i.e. an "e-Liquid") which may be based on propylene glycol, or glycerin, and may include taste and fragrance ingredients. The result is an aerosol mist. The atomization may be similar to nebulizer or humidifier vaporizing solutions for inhalation.

The e-Liquid may be kept m a container (sometimes called "cartomizer", which may be the approximate size of a regular cigarette's filter), and during the puff some of it is heated while being close to and around a heating coil (for example operated by a battery, and controlled via a control chip and a puff sensor). The heated e-Liquid loses its high viscosity, and then is prone to atomization and some evaporation, generating the "smoke" to be inhaled by the user. The atomization may be enhanced by the usage of an e-Liquid-soaked wick inside a heating coil, where the small spaces between the wick fibers and inside them enhance the breaking of the heated e-Liquid to small droplets generating the fog-like smoke. Some of the vaporized e-liquid may re-condensate to droplets, creating more fog-like smoke, due to the mix of the inhaled room-temperature air with the heated air and vapor inside the cartomizer. This effect is enhanced by the higher temperature generated by the electrically-energized heated coil, combined with the air flow (that reduces pressure around the wick due to the Bernoulli's principle, thus enhancing evaporation rate) both enhance evaporation rate, loading the air around the heating coil and wick combination with e-Liquid vapors. When this air, saturated with e-Liquid vapors, is hit by the room-temperature air flow sucked m by the user, some of its vapor may condensate into small air-borne droplets (similar to water fog in air) and add to the "smoke" generated by the e-Cig.

BRIEF DESCRIPTION OF THE DRAWINGS

The system and method may be better understood with reference to the following drawings and description. Non-limiting and non-exhaustive embodiments are described with reference to the following drawings. The components in the drawings are not necessarily to scale, emphasis instead being placed upon illustrating the principles of the invention. In the drawings, like referenced numerals designate corresponding parts throughout the different views.

DETAILED DESCRIPTION OF EMBODIMENTS

Figure 1:
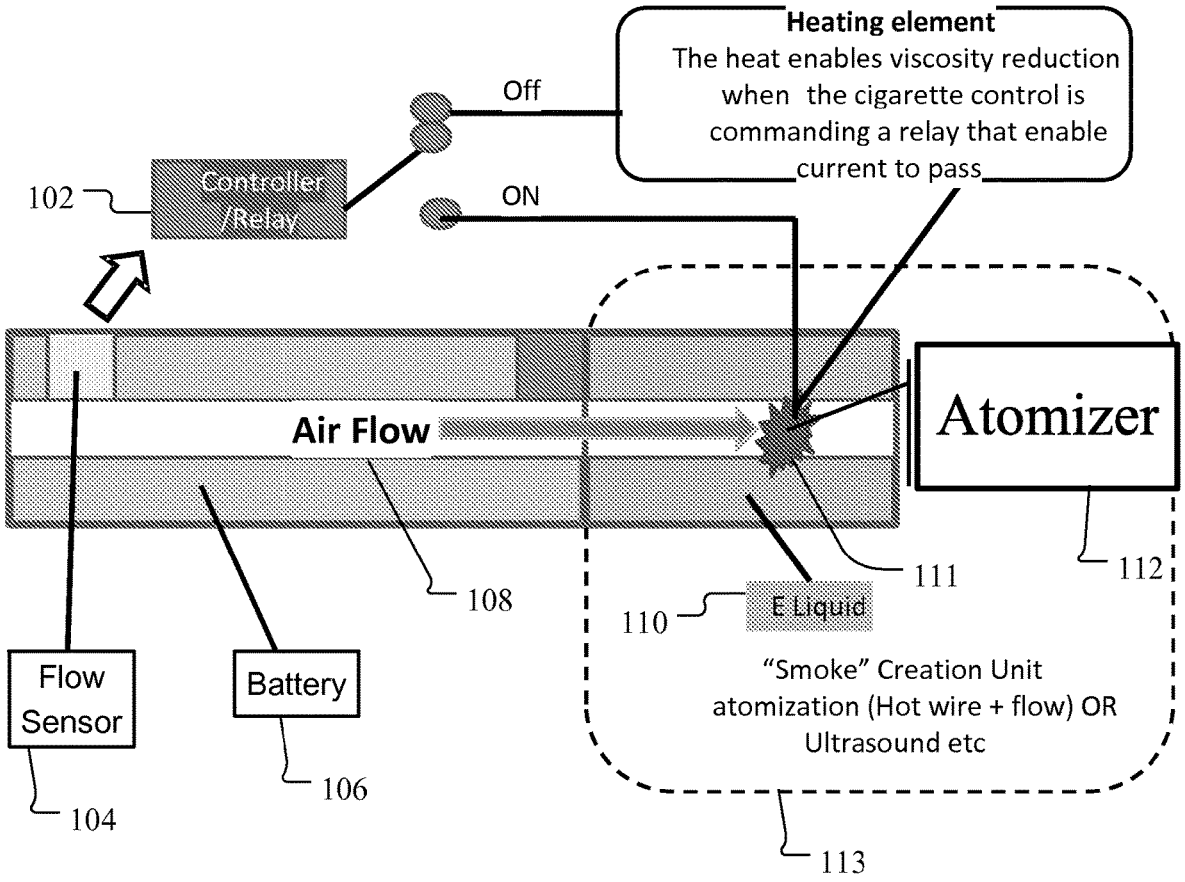
FIG. 1 is a diagram of an electronic cigarette.

The e-Cig may include a battery portion that includes the battery and controller and a cartridge which includes the cartomizer and where atomization occurs. The cartridge may need to receive power from the battery portion for the atomization process. Since the cartridge may be disposable and/or replaceable, it may need to be attached/detached from the battery portion, which may include a rechargeable battery that is configured to be paired with cartridges until the e-liquid runs out. There may be an adapter connecting the battery portion and the cartridge. In one embodiment, the adapter may be part of either the battery portion or cartridge for connecting the two. The adapter may allow for wires connecting power from the battery to the cartridge. Corrosion may result from the wires connecting the battery and the cartridge in part because the e-liquid may be reactive with certain metals. Further, contamination of the e-liquid may occur during a soldering process. Accordingly, the embodiments described below may connect wires without requiring soldering. In particular, an adapter may be utilized that that connects wires (e.g. between the battery portion and the heating element of the cartridge) without requiring soldering. The elimination of soldering can be used for automation in manufacturing. A ring, cylinder, or sleeve may be utilized for connecting and stabilizing wires connecting the battery portion to the cartridge.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware or any combination thereof (other than software per se). The following detailed description is, therefore, not intended to be taken in a limiting sense. In the following description, numerous specific details are set forth in order to provide a thorough understanding of the various principles of the embodiments. It will be apparent to one skilled in the art, however, that not all these details are necessarily always needed for practicing the embodiments.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

FIG. 1 is a diagram of an e-Cig illustrating two portions. There may be a battery portion and a cartomizer or cartridge 113 portion. Although not shown in FIG. 1, there may be an adapter connecting the two portions. The adapter may be part of the battery portion, part of the cartomizer, or a separate component. The battery portion includes a battery 106. In alternative embodiments, there may be a power source that uses a different mechanism for powering the e-Cig.

The "smoke" produced by an e-Cig is a created by turning a liquid (e-Liquid 110) into mist and some vapor with an atomizer 112. The cartomizer 113 may include the atomizer 112 and the e-liquid 110. The cartomizer 113 may also be referred to as a cartridge throughout this disclosure and may be disposable. The e-liquid 110 may have a high viscosity at room temperature to enable longer shelf life and reduce leakages; however, this high viscosity may reduce the atomization rate. The e-Liquid 110 is atomized via air flow 108, generated by the inhalation of the user (i.e. the smoker or consumer or vapor), which produces a pressure difference that removes e-Liquid droplets from the e-Liquid 110. In one embodiment, the e-Liquid 110 may be soaked in a wick (not shown), which may be connected to a heating element 111. In order to reduce the e-Liquid viscosity, to a level enabling atomization, external heat may be applied through the heating element 111. The heating element 111 may be a coil in one embodiment that wraps around the wick in order to heat the liquid on the wick. In this embodiment, local viscosity reduction via heating, while inhalation occurs, enables e-Liquid atomization in the inhalation-generated flow of air 108. An airflow tube of the battery enclosure and an airflow tube of the cartridge may enable the smoker to puff through the electronic cigarette and activate the airflow sensor inside the battery portion. This may trigger the controller and cause the coil inside the cartridge to get hot, evaporate the liquid that is in the cartridge and causes smoke (i.e. vapor).

The e-Liquid 110 may be heated via an electric current flowing through the heating element 111 and may then be atomized and evaporated through the e-Cig and may contain tastes and aromas that create a smoking sensation. The controller 102 may be activated due to air flow 108 (from the inhaled air) passing a flow sensor 104. The sensor 104 may be activated by the pressure drop across the sensor and may directly switch the battery 106 power on, or be used as an input for the controller 102 that then switches the battery 106 current on. Although illustrated as separate from the e-Cig, the controller 102 may be a part of the e-Cig (e.g. along with the battery 106). The battery portion may include one or more electronic chips controlling and communicating from it. It may connect with the cartomizer 113, which can be replaced or changed (e.g. when a new/different e-Liquid 110 is desired).

The e-Cig may include two parts. The first part may just be referred to as the battery or battery portion (i.e. battery enclosure) and it includes the power source (e.g. battery), the air flow sensor and the controller. The second part is the cartridge (i.e. cartomizer 113) that is filled up with liquid and flavors that is required for smoke and flavor generation. Although not shown in FIG. 1, the e-Cig may include connections (i.e. connectors or electrical connections) that are used for power delivery to the heating element 111. In particular, the battery portion and the cartridge may be connected by metal connectors. As described below, the connections between the battery portion and the cartridge may be through one or more connecting wires. The embodiments further described below describe that the connection is solderless which reduces potential problems (e.g. corrosion or contamination of the e-Liquid) while improving ease of manufacture for automation.

Figure 2:
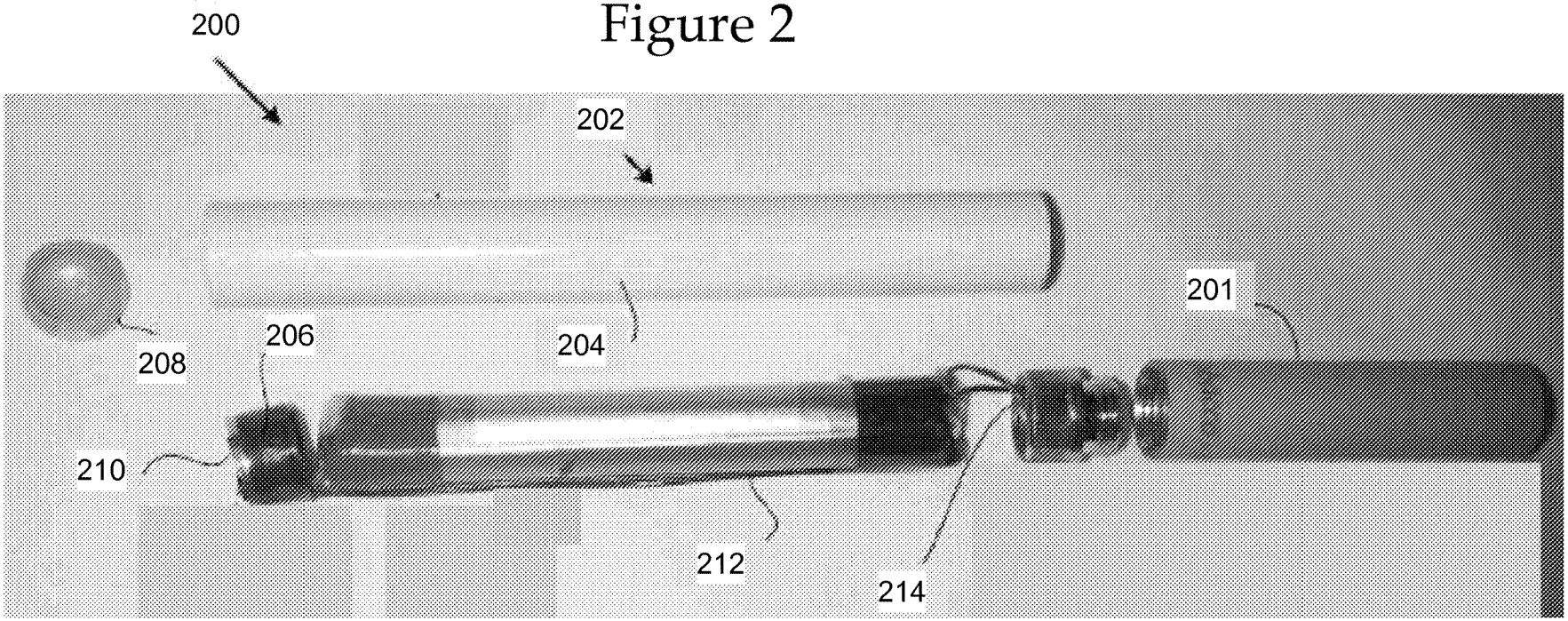
FIG. 2 is a diagram of another embodiment of an electronic cigarette.

FIG. 2 is another embodiment of an electronic cigarette 200. The e-Cig 200 includes a barrel 204 comprising a battery section 202. The battery section 202 may be referred to as a battery portion or may just be referred to as the battery. The battery section 202 may include power circuitry 210 which may be enclosed in a plastic holder 206 connected with an end 208. Exemplary power controls may be disclosed in commonly assigned U.S. patent application Ser. No. 13/962,584 (claiming priority to U.S. Provisional Application No. 61/441,133), both of which are herein incorporated by reference. Along the body 204 of the battery section 202 may be a power supply (e.g. battery) 212 and wires or metal pieces for transmitting electrical power from the battery section 202 to the cartridge 201 of the e-Cig.

The cartridge 201 houses the cartomizer/atomizer. The atomizer includes a high resistance electrical wire, which heats an e-Liquid (e.g. liquid or gel) when the atomizer is powered. The e-liquid may be a mixture of nicotine, propylene glycol, vegetable glycerin, and flavorings. The cartridge 201 is further described in commonly assigned U.S. application Ser. No. 14/051,029 (claiming priority to U.S. Prov. No. 61/474,569), both of which are herein incorporated by reference. In some embodiments, the power control circuitry 206 may be disposed in the cartridge section 201 rather than the battery section 202 as shown in FIG. 2. An adapter 214 connects the cartridge 201 and the battery section 202, and may comprise a threaded connector. Exemplary details of an adapter 214 are disclosed in the above noted U.S. application Ser. No. 14/051,029, which is herein incorporated by reference. As described below, wires are connected to metal components without soldering. Adapter 214 is pointing towards the male threaded connector on the battery side. There may be a solder on or near the battery portion because there is no liquid inside the battery portion. The female threaded connector inside the cartomizer is connected without solder.

Figure 3:
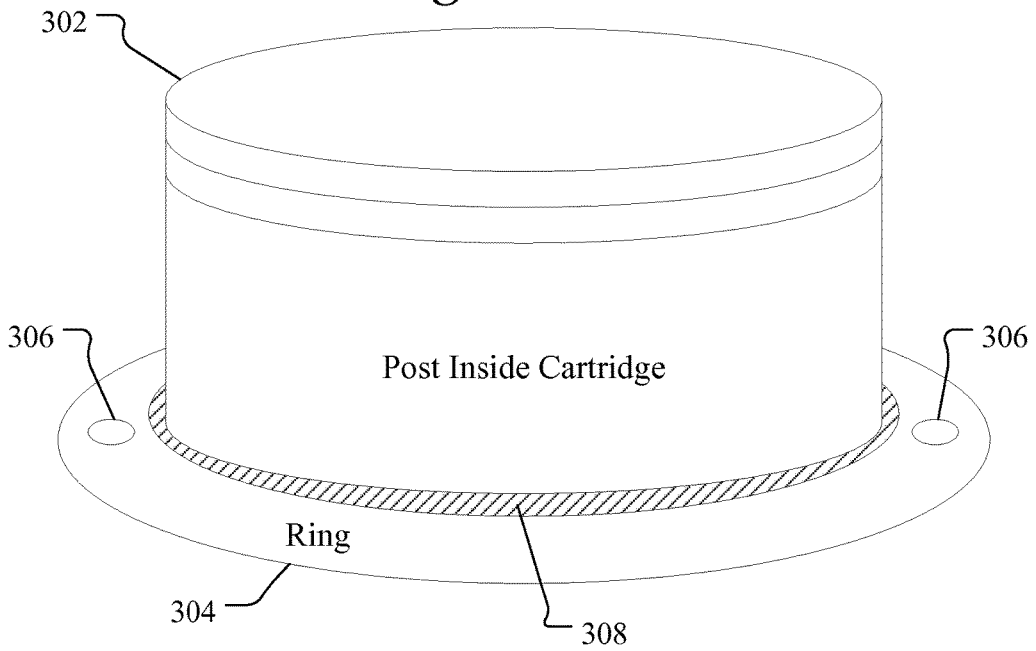
FIG. 3 is an exemplary embodiment of a wire bonding device.
Figure 6:
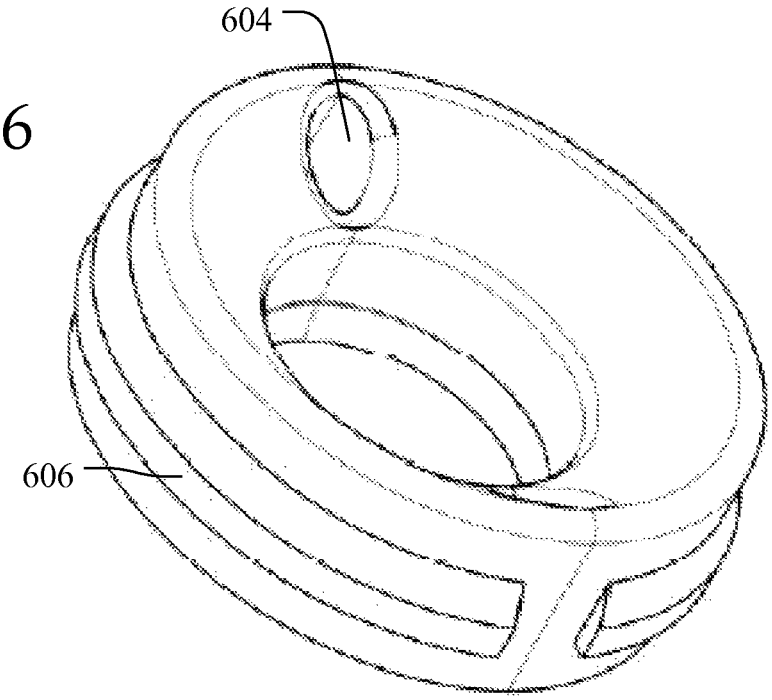
FIG. 6 is one embodiment of a ring bonding device.
Figure 7:
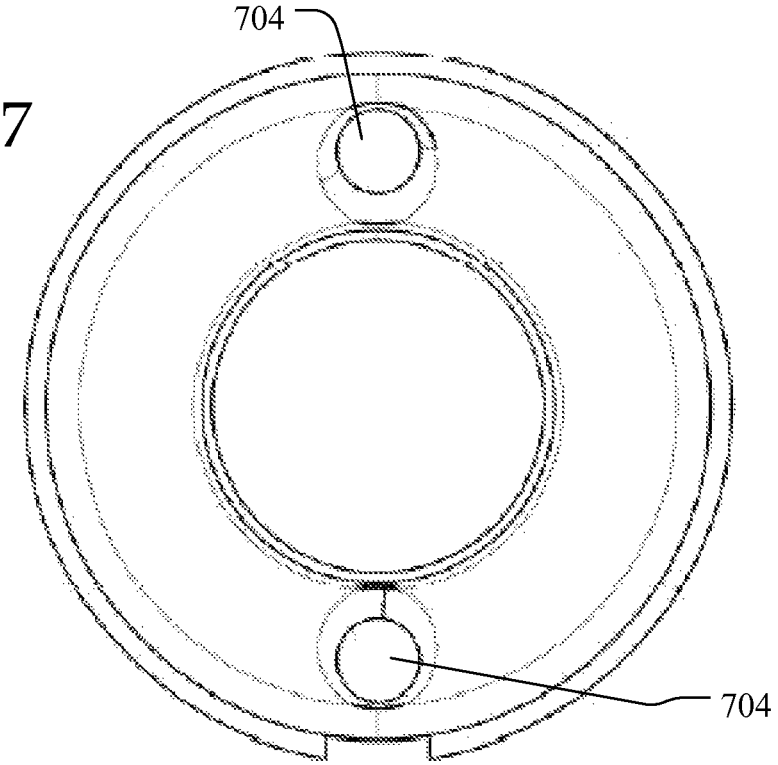
FIG. 7 is another view of one embodiment of a ring bonding device.

FIG. 3 is an exemplary embodiment of a wire bonding device. A metal post 302 may be located inside the cartridge. The post 302 may be in contact with the e-Liquid. Although not shown, the post 302 may be slightly tapered near the top in order to receive a ring 304. The ring 304 may also be referred to as a washer and may be plastic or another non-conductive material. Exemplary embodiments of the ring 304 are shown in FIGS. 6-7. The tapering of the post 302 may permit the ring 304 to slide over the post's surface and compress a metal wire, such as wires shown in FIG. 4. The ring 304 includes one or more holes 306 for receiving wires to be compressed. The ring 304 may be situated against the post 302 such that there is at least some gap 308 between the ring and the post 302. The gap 308 may not be all the way around the ring 304 and in some embodiments; there may be one or more gaps 308 with no gaps at other portions of the ring 304.

Figure 4:
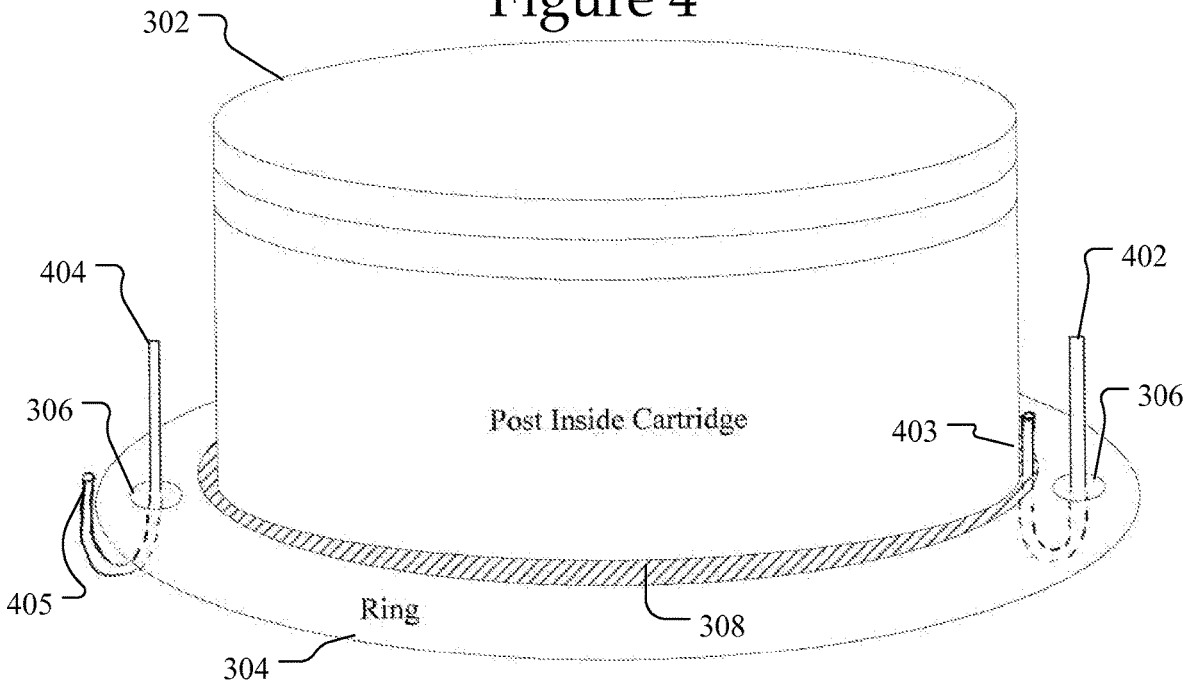
FIG. 4 is an exemplary embodiment of a bonding device illustrating exemplary wire positions.

FIG. 4 is an exemplary embodiment of a bonding dev ice illustrating exemplary wire positions. FIG. 4 illustrates the ring 304 with two holes 306 that receive two wires 402 and 404. The first wire 402 passes through one of the holes 306 and is compressed in the gap 308 against the post 302 at 403. The compression at 403 holds the wire against the post 302. The second wire 404 is located through another one of the holes 306 and held against an outer surface of the ring 306. The ring 304 serves to compress wire 404 to a component outside the ring, such an outer metallic ring at 405. The outer metallic ring is not explicitly shown in FIG. 4, but is located at 405. In alternative embodiments, multiple wires may be on the inside of the ring 304 (through the gap 308) or may be pressed on an outside of the ring 304 against an outer surface (e.g. an outer metallic ring).

The wires 402, 404 may pass electrical power from the battery portion to the cartridge (e.g. to the heating element). Although two wires are illustrated, there may be more or fewer wires for transmitting power or data. Although the exemplary wires are illustrated as round, they may be other shapes, such as flat. The contact required may merely be a touching with a surface (e.g. metal surface). Accordingly, the ring 304 serves to press surfaces of the wire and another metal together to create a contact. A simple jig may be made to hold and press the ring 304 down to snap into place against the outer metal body, which can speed up assembly.

The transmission of power may be through the wires and other metal surfaces which the wires touch. The wires may be made from a metal material, such as nickel, gold, or nickel-coated copper. The post may be metal and may be gold-plated in one embodiment. The heating coil may be a nickel alloy, so the wires 402, 404 may be nickel-coated copper to avoid galvanic effects caused by prolonged contact with the e-Liquid. The post 302 and/or the ring 304 may be gold plated or nickel plated.

Figure 5:
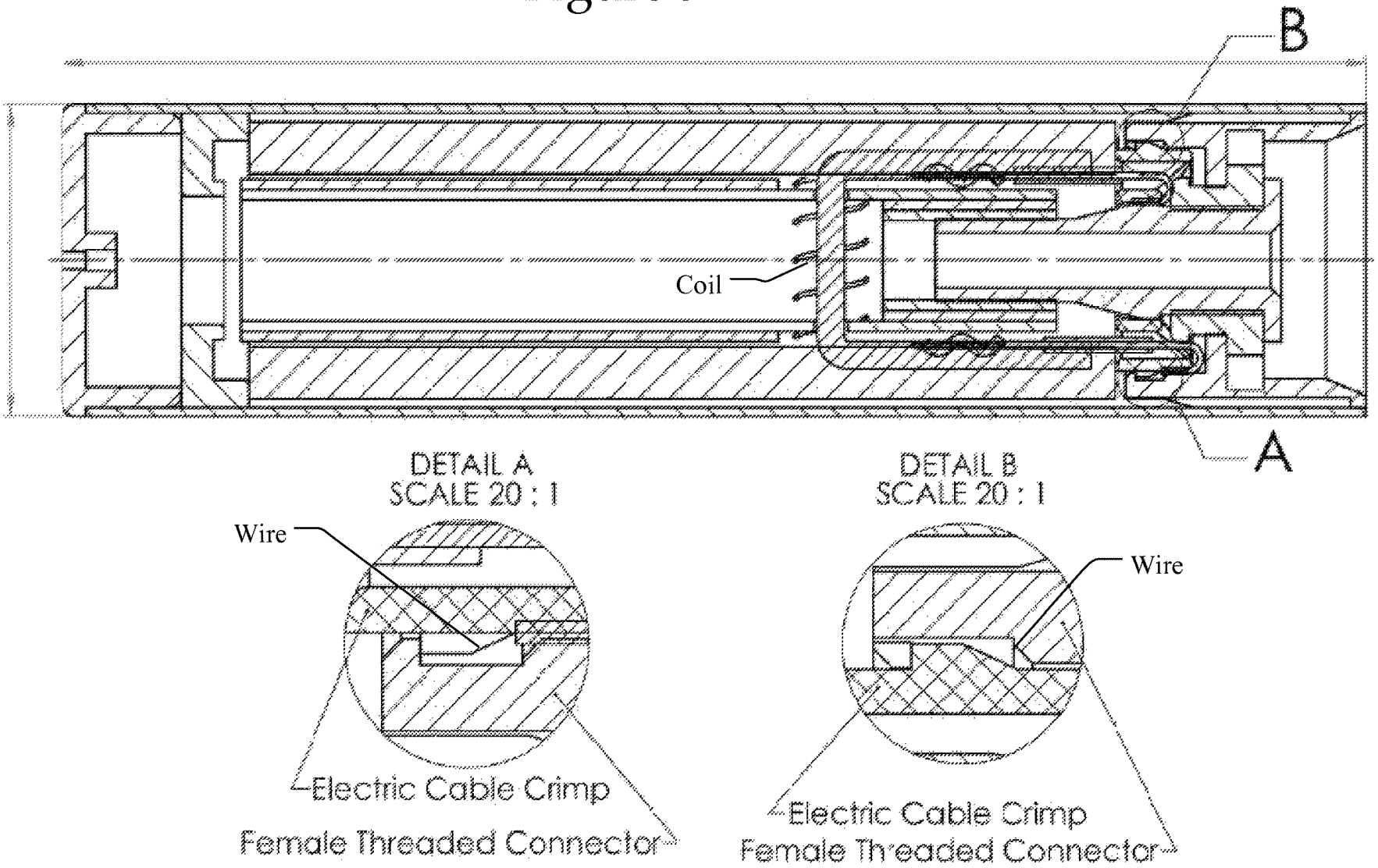
FIG. 5 is a diagram of the bonding device in a cartridge.

FIG. 5 is a diagram of the bonding device in a cartridge. The right side of FIG. 4 passes towards the battery portion, while the illustrated portion of the e-Cig includes the cartridge and shows the heating coil. As discussed, the heating coil may receive electric power from the battery portion. Detail sections A and B illustrate portions of the cartridge where the wire may pass. Detail section A illustrates the wire between the electric cable crimp and the female threaded connector. The electric cable crimp is the wire bonding device, such as the ring 304. The female threaded connector may be an example of an outer metallic ring. The wire is illustrated in FIG. 5 as being compressed between the electric cable crimp (i.e. bonding device, such as the ring 304) and the female threaded connector (i.e. metal component, such as an outer metallic ring).

FIG. 6 is one embodiment of a ring bonding device. The ring may include one or more holes 604 for the wire to pass through. After the wire passes through the hole 604, it may be pressed against the outside or inside of the ring against another material. The ring may include a protrusion 606 for snapping into or the cartridge. The protrusion may couple with a threaded connector or other component.

FIG. 7 is another view of one embodiment of a ring bonding device. FIG. 7 illustrates an embodiment of a bonding ring with two holes 704. FIG. 7 may be a top down view of the ring illustrated in FIG. 6.

Figure 8:
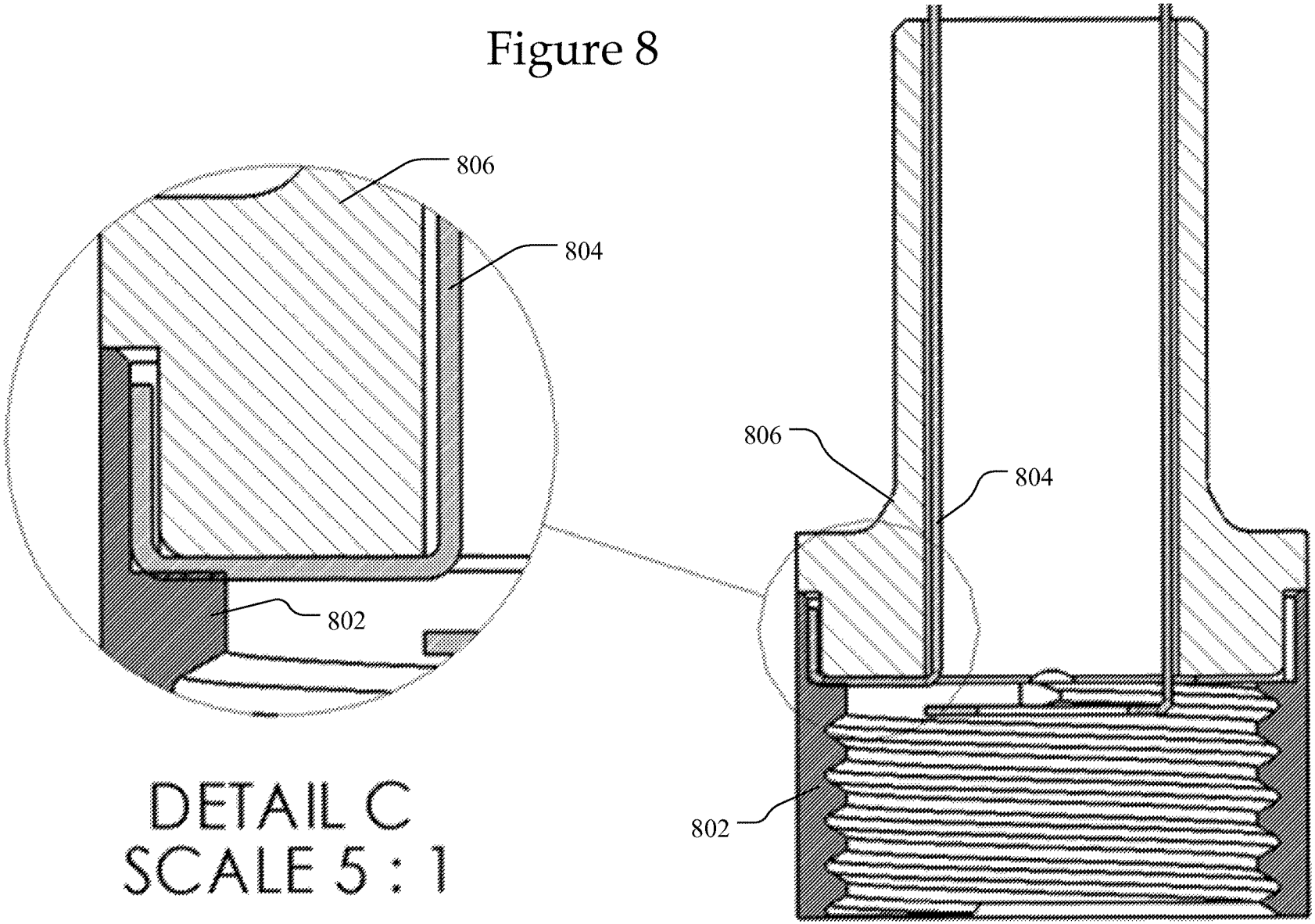
FIG. 8 is a cross-sectional view of a bonding device that includes a cylindrical sleeve.

FIG. 8 is a cross-sectional view of a bonding device that includes a cylindrical sleeve 806. The cylindrical sleeve 806 may be a plastic material. A metallic strip 804 is pressed by the sleeve 806 against the metal threaded connector 802. In this embodiment, the wire (discussed above) is the metallic strip 804. The sleeve 806 presses the strip 804 (i.e. the wire) against the metal threaded connector 802 (i.e. the contact point) for transmitting power. Although not labeled, the metal threaded connector may connect with the battery portion for receiving electrical power from the battery (e.g. through the metal threaded connector). In the embodiment, shown in FIG. 8, the bonding device is a sleeve that presses a metallic strip (or a wire) against a contact point (e.g. threaded connector 802).

Figure 9:
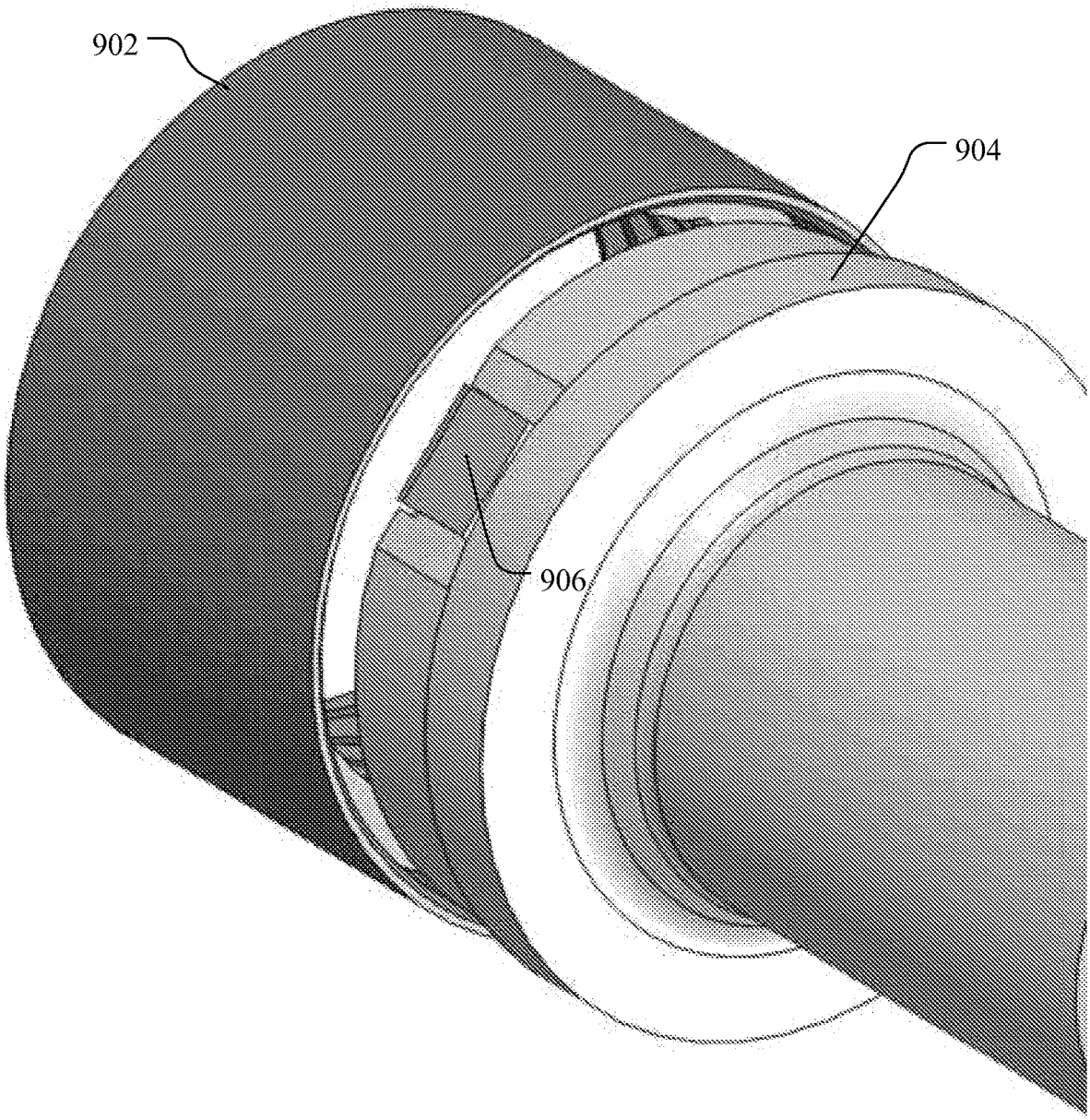
FIG. 9 is an isometric view of a bonding device that includes a cylindrical sleeve.

FIG. 9 is an isometric view of a bonding device that includes a cylindrical sleeve 904. The embodiment shown in FIG. 9 may be the same sleeve shown in FIG. 8. The metal strip 906 is pressed by the cylindrical sleeve 904 against the metal threaded connector 902. The metal threaded connector 902 is only partially displayed so that the cylindrical sleeve 904 and the metal strip 906 are visible.

Figure 10:
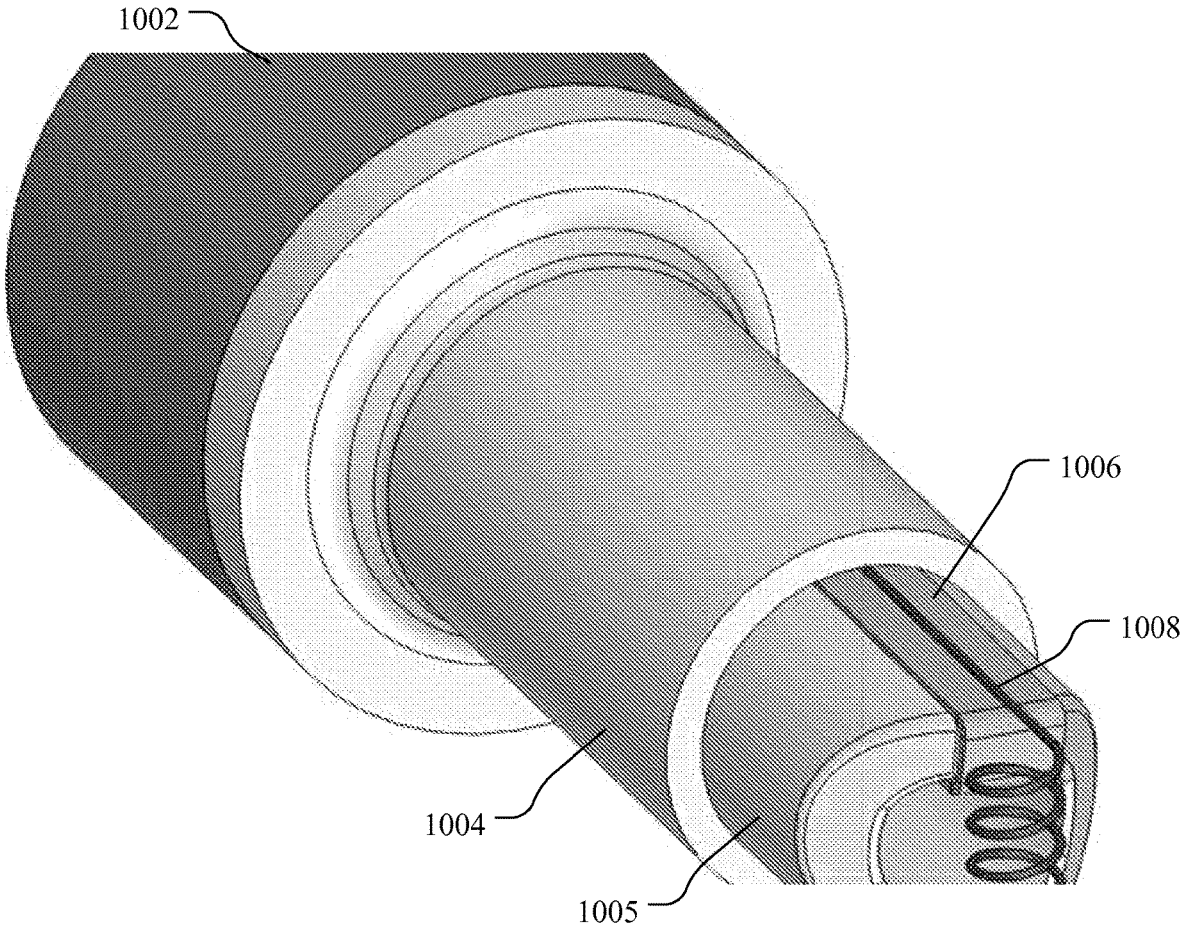
FIG. 10 is an isometric view of a bonding device that includes two cylinders.

FIG. 10 is an isometric view of a bonding device that includes two cylinders. In particular, the bonding device comprises two cylinders in this embodiment. In alternative embodiments, the two cylinders shown in FIG. 10 may be a single component. An outer cylinder 1004 and an inner cylinder 1005 may be used to pin a wire 1008 against a metal strip 1006. In other words, the contact between the wire 1008 with the metal strip 1006 is caused by the tension between the two cylinders 1004, 1006. As shown the wire 1008 may be metal and may power the heating element of the e-Cig.

Figure 11:
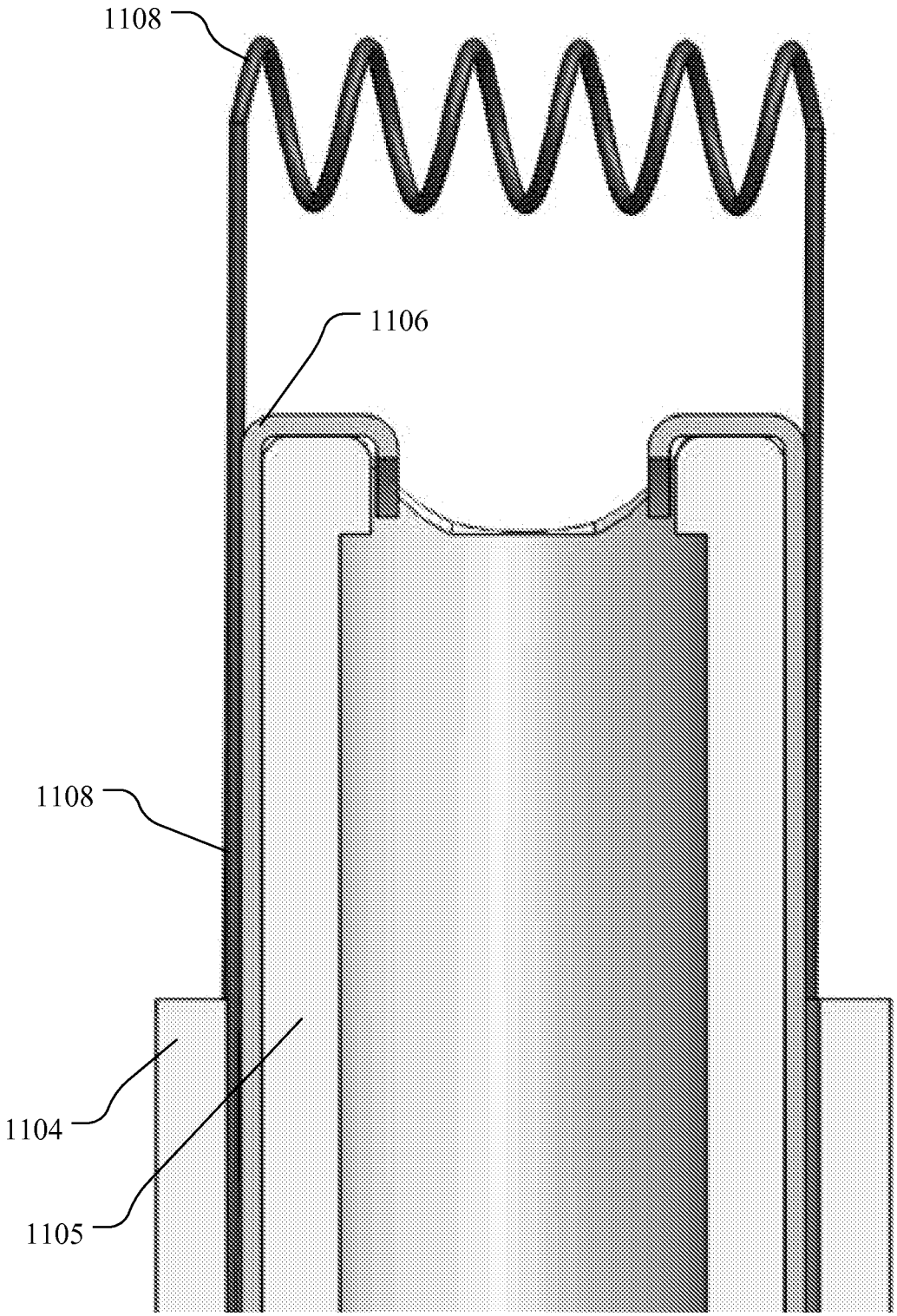
FIG. 11 is another view of a bonding device that includes two cylinders.

FIG. 11 is another view of a bonding device that includes two cylinders 1104, 1105. The embodiment shown in FIG. 11 may be the same as FIG. 10 with two cylinders as the bonding element. The two cylinders 1104, 1105 bonds or contacts the wire 1108 with the metal strip 1106. FIG. 11 shows how the two cylinders 1104, 1105 can press together the wire 1108 and the metal strip 1106 to make electrical contact.

Figure 12:
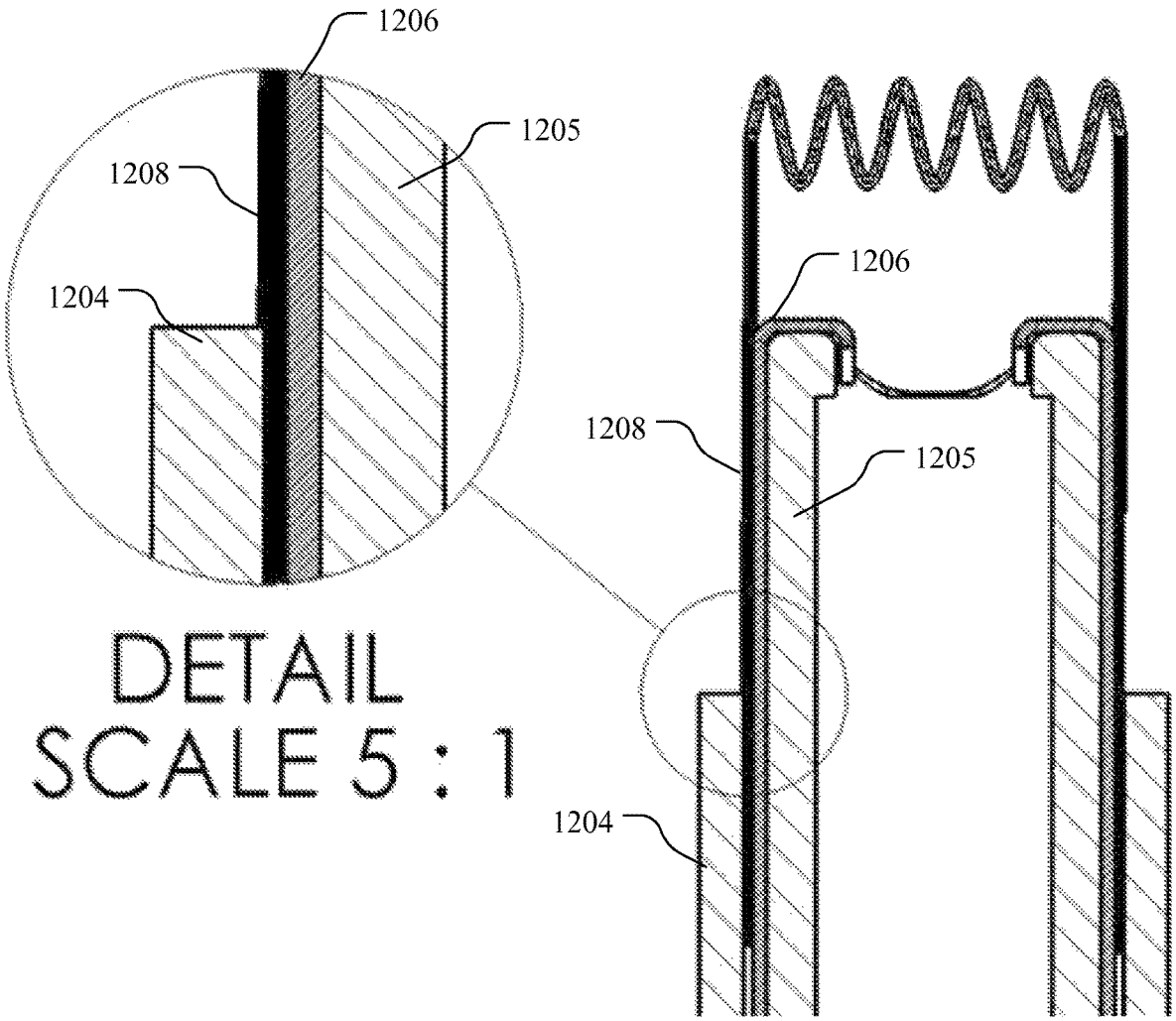
FIG. 12 is a cross-sectional view of a bonding device that includes two cylinders.

FIG. 12 is a cross-sectional view of a bonding device that includes two cylinders 1204, 1205. The embodiment shown in FIG. 12 may be the same as FIGS. 10-11 where the two cylinders 1204, 1205 form the bonding device that bonds the metal strip 1206 with the wire 1208.

The embodiments described above are for a wire bonding/containment system for creating an electrical connection within an e-Cig. The electrical connection may be a wire between the battery element and the heating element in the cartridge. The wire bonding/containment device may be a ring, washer, sleeve(s), or cylinder(s) for holding and connecting wires with other surfaces.

The bonding devices described above are merely exemplary and alternative embodiments may be used for connections in the e-Cig. As described, a bonding device may refer to any structure of component(s) that are used for bonding objects such as wires for the transmission of electrical power. One embodiment of a bonding device creates a contact point between a wire and another conducting (e.g. metal) surface. The bonding device (e.g. ring, washer, sleeve/sleeves, cylinder/cylinders, etc.) may be made of non-conducting or a combination of conductive and non-conductive material that may be strong enough and provide rigidity to continuously and consistently press the wires against metal bodies. The rigidity may ensure that the wires are pressed hard against the metal bodies and keep them pressed for a long operation period. The bonding device may be able to withstand the tough e-liquid environment and can handle one or more wires simultaneously. The bonding device may fit securely within the cartridge (e.g. snapping into place). Assembly of the bonding device may no longer require soldering, which can reduce the cost of production, including the elimination of expensive soldering equipment, and the need for special localized ventilation infrastructure for the each soldering station in the facility. The bonding devices can be designed to be molded, or manufactured by machining, depending on material being used.

It will be appreciated by persons skilled in the art that the present invention is not limited to what has been particularly shown and described hereinabove. Rather, the scope of the present invention includes both combinations and sub-combinations of the various features described hereinabove, as well as variations and modifications thereof that are not in the prior art, which would occur to persons skilled in the art upon reading the foregoing description.

The invention claimed is:

1. An electronic vaping device comprising:

a battery portion that provides power to the electronic vaping device;

a cartomizer coupled with the battery portion that comprises:

a heating element; and a bonding device for causing at least two wires to form an electrical connection between the heating element and the battery portion, the bonding device including a ring, the ring configured to press the at least two wires against at least two conductive components to establish the electrical connection, the at least two wires including a first wire and a second wire, the at least two conductive components including a first conductive component and a second conductive component, the first wire being pressed by the ring against the first conductive component, the second wire being pressed by the ring the against the second conductive component, the first conductive component being inside of the ring, the second conductive component being outside of the ring;

wherein the ring includes at least two holes, the at least two holes including a first hole and a second hole, the first wire passing through the first hole, and the second wire passing through the second hole.

2. The electronic vaping device of claim 1, wherein the bonding device establishes the electrical connection without soldering of the first wire to the first conductive component.

3. The electronic vaping device of claim 1, wherein the bonding device establishes the electrical connection without soldering of the second wire to the second conductive component.

4. The electronic vaping device of claim 1, wherein the first conductive component being inside of the ring includes a post passing through the ring.

5. The electronic vaping device of claim 4, wherein the ring is configured to pinch the first wire between the post and the ring.

6. The electronic vaping device of claim 1, wherein the second conductive component being outside of the ring includes a metallic component around the ring.

7. The electronic vaping device of claim 1 wherein the cartomizer further comprises:

a liquid container for holding a liquid.

8. The electronic vaping device of claim 1, wherein the bonding device is a part of an adapter that connects the battery portion with the cartomizer.

9. An electronic vaping device comprising:

a battery;

a heating element; and a bonding device for causing at least two wires to form an electrical connection between the heating element and the battery, the bonding device including a ring, the ring configured to press the at least two wires against at least two conductive components to establish the electrical connection, the at least two wires including a first wire and a second wire, the at least two conductive components including a first conductive component and a second conductive component, the first wire being pressed by the ring against the first conductive component, the second wire being pressed by the ring the against the second conductive component, the first conductive component being inside of the ring, the second conductive component being outside of the ring wherein the ring includes at least two holes, the at least two holes including a first hole and a second hole, the first wire passing through the first hole, and the second wire passing through the second hole.

10. The electronic vaping device of claim 9, wherein the bonding device establishes the electrical connection without soldering of the first wire to the first conductive component.

11. The electronic vaping device of claim 9, wherein the bonding device establishes the electrical connection without soldering of the second wire to the second conductive component.

12. The electronic vaping device of claim 11, wherein the ring is configured to pinch the first wire between the ring and a post passing through the ring.

13. The electronic vaping device of claim 9, wherein the first conductive component being inside of the ring includes a post passing through the ring.

14. The electronic vaping device of claim 9, wherein the second conductive component being outside of the ring includes a metallic component around the ring.

15. The electronic vaping device of claim 9, further comprising:

a liquid container for holding a liquid.

16. An electronic vaping device comprising:

a battery element that includes a battery;

a cartomizer coupled with the battery element; and a bonding device for causing at least two wires to form an electrical connection between the cartomizer and the battery, the bonding device including a ring, the ring configured to press the at least two wires against at least two conductive components to establish the electrical connection, the at least two wires including a first wire and a second wire, the at least two conductive components including a first conductive component and a second conductive component, the first wire being pressed by the ring against the first conductive component, the second wire being pressed by the ring the against the second conductive component, the first conductive component being inside of the ring, the second conductive component being outside of the ring, wherein the ring includes at least two holes, the at least two holes including a first hole and a second hole, the first wire passing through the first hole, and the second wire passing through the second hole.

17. The electronic vaping device of claim 16, wherein the bonding device establishes the electrical connection without soldering of the first wire to the first conductive component.

18. The electronic vaping device of claim 16, wherein the bonding device establishes the electrical connection without soldering of the second wire to the second conductive component.

19. The electronic vaping device of claim 18, wherein the ring is configured to pinch the first wire between the ring and a post passing through the ring.

20. The electronic vaping device of claim 16, wherein the first conductive component being inside of the ring includes a post passing through the ring.

21. The electronic vaping device of claim 16, wherein the second conductive component being outside of the ring includes a metallic component around the ring.

22. The electronic vaping device of claim 16, wherein the cartomizer comprises:

a liquid container for holding a liquid.

23. The electronic vaping device of claim 16, wherein the cartomizer comprises:

a heating element configured to heat a wick with liquid.

24. The electronic vaping device of claim 16, wherein the bonding device is part of the cartomizer.

* * * * *